US008485408B2

(12) United States Patent
Tanaka

(10) Patent No.: US 8,485,408 B2
(45) Date of Patent: Jul. 16, 2013

(54) GAS COMBUSTION TYPE DRIVING TOOL

(75) Inventor: Hiroshi Tanaka, Tokyo (JP)

(73) Assignee: Max Co., Ltd., Tokyo (JP)

( * ) Notice: Subject to any disclaimer, the term of this patent is extended or adjusted under 35 U.S.C. 154(b) by 36 days.

(21) Appl. No.: 12/666,945

(22) PCT Filed: Jun. 24, 2008

(86) PCT No.: PCT/JP2008/061489

§ 371 (c)(1),
(2), (4) Date: Dec. 28, 2009

(87) PCT Pub. No.: WO2009/004954

PCT Pub. Date: Jan. 8, 2009

(65) Prior Publication Data

US 2010/0193561 A1 Aug. 5, 2010

(30) Foreign Application Priority Data

Jun. 29, 2007 (JP) ..... 2007-171660

(51) Int. Cl.
*B25C 1/08* (2006.01)

(52) U.S. Cl.
USPC ..... 227/10; 123/46 SC

(58) Field of Classification Search
USPC ..... 227/8–10, 130; 123/46 SC, 46 R
See application file for complete search history.

(56) References Cited

U.S. PATENT DOCUMENTS

| | | | | |
|---|---|---|---|---|
| 4,320,864 | A * | 3/1982 | Novak et al. | 227/130 |
| 4,403,722 | A * | 9/1983 | Nikolich | 227/8 |
| 4,483,473 | A * | 11/1984 | Wagdy | 227/8 |
| 5,197,646 | A * | 3/1993 | Nikolich | 227/8 |
| 5,199,626 | A * | 4/1993 | Terayama et al. | 227/10 |
| 6,505,767 | B2 * | 1/2003 | Thieleke et al. | 227/10 |
| 6,755,159 | B1 | 6/2004 | Adams et al. | |
| 7,021,251 | B2 * | 4/2006 | Ohmori et al. | 123/46 R |
| 7,063,053 | B2 * | 6/2006 | Hirai et al. | 123/46 SC |
| 7,201,301 | B2 * | 4/2007 | Moeller et al. | 227/8 |
| 7,487,898 | B2 * | 2/2009 | Moeller et al. | 227/8 |
| 7,743,955 | B2 * | 6/2010 | Nishikawa et al. | 227/9 |
| 2004/0182336 | A1 * | 9/2004 | Ohmori et al. | 123/46 R |
| 2005/0173484 | A1 * | 8/2005 | Moeller et al. | 227/8 |

FOREIGN PATENT DOCUMENTS

| | | |
|---|---|---|
| JP | 3-142177 A | 6/1991 |
| JP | 4-146087 | 5/1992 |
| JP | 2004-223709 A | 8/2004 |
| JP | 2004-299043 | 10/2004 |
| JP | 2005-329533 | 12/2005 |
| JP | 2007-90506 | 4/2007 |

* cited by examiner

*Primary Examiner* — M. Alexandra Elve
*Assistant Examiner* — Andrew M Tecco
(74) *Attorney, Agent, or Firm* — Drinker Biddle & Reath LLP

(57) ABSTRACT

A cylinder head 14 is provided above a cylinder 7 for slidably accommodating a piston 8. A cylindrical movable sleeve 32 is disposed movably between the cylinder 7 and the cylinder head 14. A connecting portion is provided above the cylinder 7, and the cylinder 7 and the cylinder head 14 are connected via the connecting portion. A body cover 2 covers an outside of the connecting portion.

8 Claims, 8 Drawing Sheets

GAS COMBUSTION TYPE DRIVING TOOL

TECHNICAL FIELD

The present invention relates to an improved body structure of a gas combustion type driving tool.

BACKGROUND ART

Generally, a gas combustion type driving tool has a cylinder, a piston, and a cylinder head disposed above the cylinder to make up a fastener driving mechanism, which are formed of metal such as aluminum, and the cylinder and the cylinder head are fixed to a body made of synthetic resin. That is, the cylinder head is fixed to an upper end of the body, and the cylinder is fixed to an intermediate part and a lower portion of the body. A movable sleeve is disposed to be movable in a vertical direction between the cylinder and the cylinder head, and a combustion chamber is formed therein, and opened or closed by the movable sleeve (refer to patent document 1).

Patent document 1: JP-A-2005-329533

In the above gas combustion type driving tool, the combustion chamber is placed in a tightly closed state by moving the movable sleeve upward. A fuel gas is supplied into the tightly closed combustion chamber, and agitated and mixed with the air by a central rotating fan to obtain a mixed gas. The mixed gas is ignited and explosively burned by an ignition plug. The piston within the cylinder is driven by the combustion pressure, and a fastener is driven from a nose portion provided on a lower portion of a tool main body by a driver integrally connected with the piston.

However, there is the following problem with the constitution in which the cylinder and the cylinder head made of metal are fixed to the body made of synthetic resin. That is, when the mixed gas is explosively burned within the combustion chamber at the time of driving, a temperature within the combustion chamber rises to considerably high temperature, and the cylinder head is subjected to a great pulling force upward and the cylinder is subjected to a great pulling force downward owing to the combustion pressure. Also, when the piston is driven to hit against a bumper at a lower end of the cylinder, a great inertial force acts on the body. In this manner, because of such a structure that a force applied on the cylinder head or cylinder at the time of driving is received by the body made of synthetic resin, a rigidity is required for the body. Further, the body made of synthetic resin is easily deformable when subjected to heat or external force, changing the relative positional dimension between the cylinder and the cylinder head fixed to the body, so that a seal failure or an up and down operation failure of the combustion chamber is caused. Therefore, it is required to increase the thickness of the body, which causes the weight to increase.

Also, an upper housing 50 making up an upper portion of the body is sufficient if there is a space for disposing a fan motor, an ignition plug and an exhaust nozzle, as shown in the fore side of FIG. 4, similarly to the cylinder head. However, a square garnish rim 54 for connecting via a bridge 51 and an annular portion 53 to a lower housing 55 must be provided outside the required space. As a stress acting on the central part of the cylinder heat owing to a combustion pressure or inertial force is concentrated on the bridge 51, it is required that there is an enough volume as the thickness to secure the strength of the bridge 51. Therefore, there was a problem that the total weight was increased.

SUMMARY OF INVENTION

One or more embodiments of the invention relates to a gas combustion type driving tool having such a body structure that can realize a weight reduction and make a smooth operation at any time, while securing a high strength to sufficiently withstand a combustion pressure or inertial force at a time of driving, particularly by directly connecting a cylinder and a cylinder head.

In accordance with a first aspect of the invention, in a gas combustion type driving tool in which a cylinder head is provided above a cylinder for slidably accommodating a piston, a cylindrical movable sleeve is disposed movably between the cylinder and the cylinder head, a combustion chamber is formed inside the movable sleeve, the combustion chamber is opened and closed by a movement of the movable sleeve, a mixed gas is ignited and burned in a tightly closed state of the combustion chamber, and an exhaust and a suction are performed in an open state of the combustion chamber, a connecting portion is provided above the cylinder, the cylinder and the cylinder head are connected via the connecting portion, and a body cover for covering the outside of the connecting portion.

In accordance with a second aspect of the invention, in the gas combustion type driving tool of the first aspect, the connecting portion is formed in a wall shape, and an opening portion is formed to penetrate through the connecting wall.

In accordance with a third aspect of the invention, in the gas combustion type driving tool of the first or second aspect, the connecting portion is formed in a pillar shape.

In accordance with a fourth aspect of the invention, in the gas combustion type driving tool of any one of the first to third aspects, the connecting portion is disposed inside the movable sleeve.

In accordance with a fifth aspect of the invention, in the gas combustion type driving tool of any one of the first to fourth aspects, wherein the connecting portion is disposed outside the movable sleeve.

In accordance with a sixth aspect of the invention, in the gas combustion type driving tool of the first aspect, instead of the connecting portion, a connecting bolt is used for directly connecting the cylinder with the cylinder head.

According to the first aspect, since the connecting portion is extend from an upper portion of the cylinder and an upper end of the connecting portion is connected with the cylinder head, the cylinder and the cylinder head are integrated. Since this is a connection between the metal members, a sufficient strength is secured. Accordingly, the relative positional dimension between the cylinder and the cylinder head is not changed owing to a combustion pressure or inertial force at a time of driving.

Since the outside of the cylinder and the cylinder head is covered with the body cover, the body cover is not the member for fixing the cylinder or cylinder head, but simply the cover. Therefore, it is unnecessary to increase the thickness of the body cover to increase the volume and the size. Accordingly, it is possible to realize the weight reduction and the slim structure.

Further, since the cylinder and the cylinder head are directly connected, the relative position between the cylinder and the cylinder head can be kept invariable, whereby there occurs no seal failure or up and down operation failure of the combustion chamber, and the smooth operation can be always performed.

According to the second aspect, since the connecting portion is formed in a wall shape and the opening portion is formed to penetrate through the connecting wall, the cylinder and the cylinder head are firmly connected together and the connecting wall is not heavier than necessary owing to the opening portion, whereby the light weight is not hampered.

According to the third aspect, since the connecting portion is formed in the pillar shape, the cylinder and the cylinder head can be connected by the lightest connecting portion.

According to the fourth aspect, since the connecting portion is disposed inside the movable sleeve, the entire driving tool can be made slim.

According to the fifth aspect, since the connecting portion is disposed outside the movable sleeve, the diameter of the combustion chamber formed inside the movable sleeve can be increased, whereby the total height of the entire driving tool can be reduced.

According to the sixth aspect, since instead of the connecting portion, the connecting bolt is used for directly connecting the cylinder with the cylinder head, the same effect as the first aspect can be obtained with the simple structure.

Other aspects and advantages of the invention will be apparent from the following description, the drawings and the claims.

DESCRIPTION OF REFERENCE NUMERALS AND SIGNS

Figure 1:
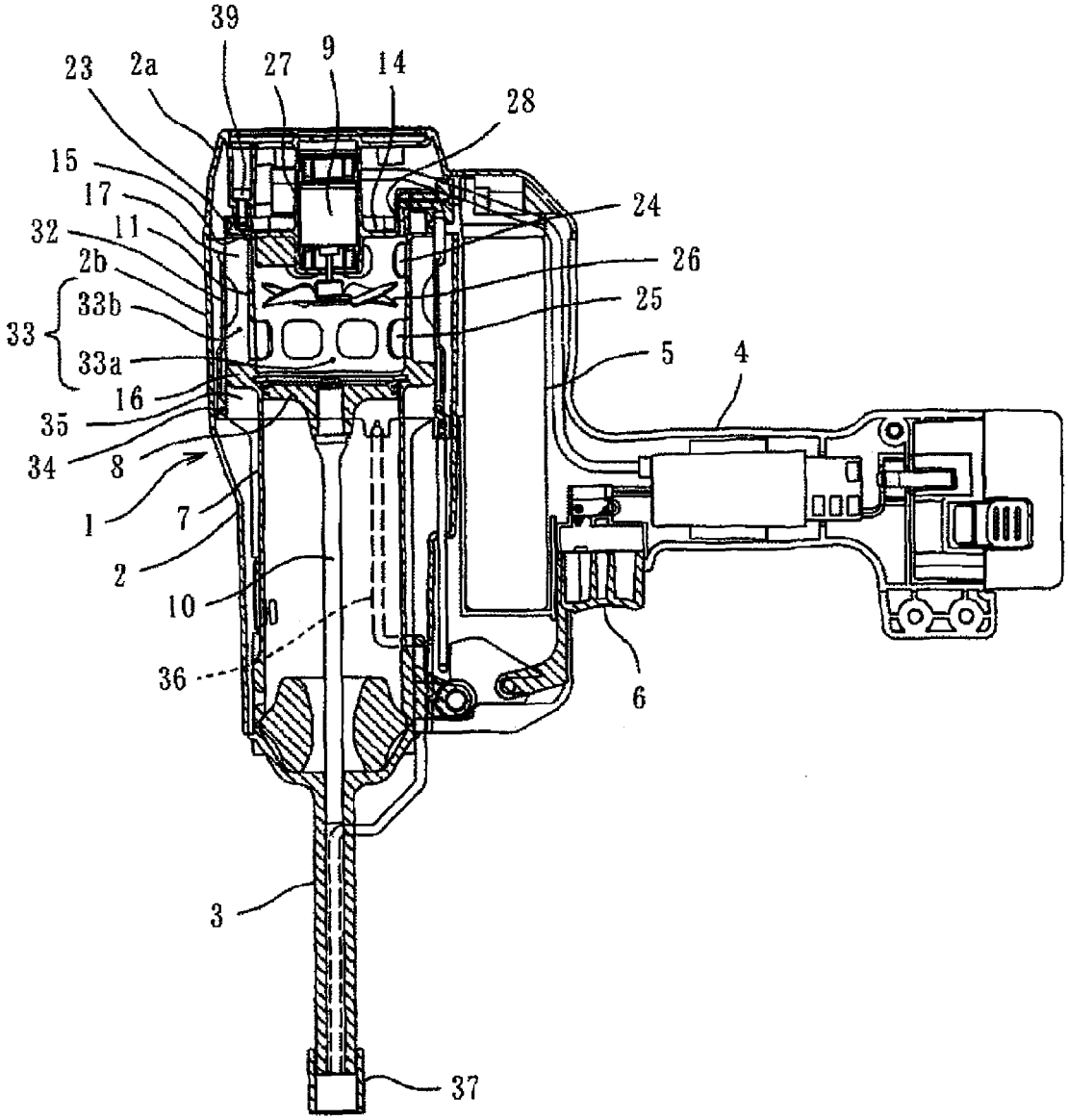
FIG. 1 is a longitudinal cross-sectional view showing an essence of a gas fuel nailing machine according to an embodiment of the present invention in a state where a combustion chamber is opened.

A gas combustion type driving tool
2 body cover
7 cylinder
11 connecting wall
12 connecting pillar
13 fixing bolt
14 cylinder head
32 movable sleeve
33 combustion chamber Description of Embodiments A nailing machine will be described below in order to explain a gas combustion type driving tool according to the present invention.

In FIGS. 1 to 4, reference numeral 1 denotes a tool main body of a gas combustion type driving tool (nailing machine). This tool main body 1 is provided with a combustion chamber and a piston cylinder mechanism inside a body cover 2, and a nose portion 3 for delivering a nail is provided under the tool main body 1. Also, the tool main body 1 has a grip 4 connected via a magazine (not shown) to the nose portion 3, and a gas container 5 removably provided on the side of the grip 4 of the tool main body 1. Reference numeral 6 denotes a trigger.

The piston cylinder mechanism slidably accommodates a piston 8 within a cylinder 7 and connects integrally a driver 10 under the piston 8.

By the way, a cylindrical connecting wall 11 is provided as a connecting portion on an extending portion above the cylinder 7. An upper end of the connecting wall 11 is butt joined with a lower surface of a cylinder head 14 formed inside an upper cover 2*a* of the tool main body 1 and integrally connected. That is, a doughnut-like flange 15 is formed on the outer circumference of the upper end of the connecting wall 11. A bulge portion 16 is annularly formed on the outer circumference of the lower end of the connecting wall 11 (upper end of the cylinder 7). The flange 15 and the bulge portion 16 are connected via eight ribs 17 at an equal interval. Further, a tapped hole 20 for a fixing bolt 18 is formed on an upper portion of each rib 17 and opened to the upper surface of the flange 15.

On the contrary, an annular portion 21 is formed on the outer circumference of the cylinder head 14, in which a bolt insertion hole 22 is formed in the annular portion 21 and an O-ring 23 is attached on the outer circumferential surface of the annular portion 21.

Figure 2A:
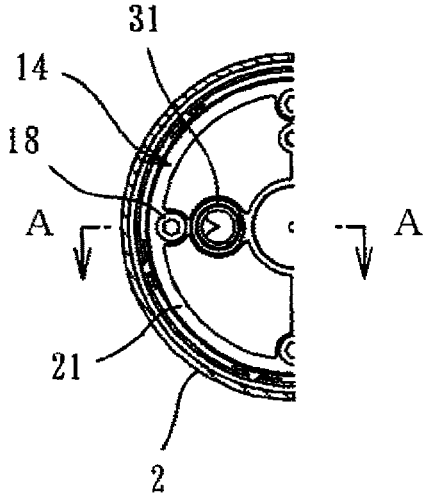
FIG. 2(*a*) is a plan view showing the essence of a cylinder head of FIG. 1, as seen from the upper surface, and FIG. 2(*b*) is a cross-sectional view, taken along the line A-A of FIG. 2(*a*).
Figure 2B:
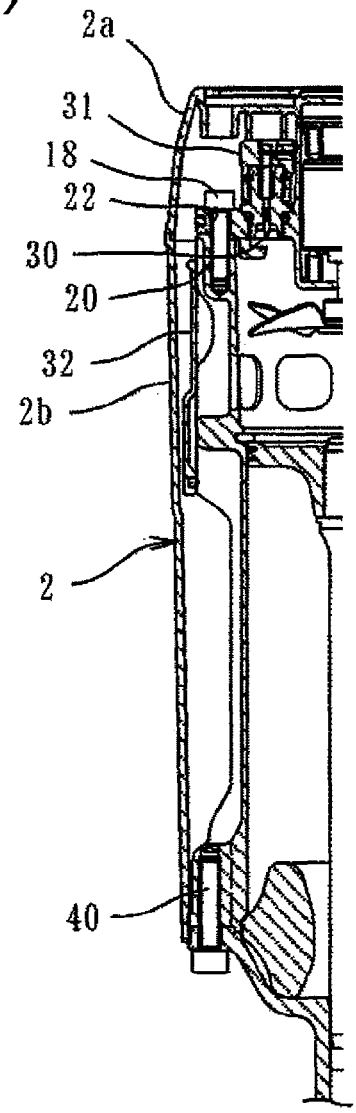

As shown in FIGS. 2(*a*), 2(*b*) and 4, the flange 15 at the upper end of the connecting wall 11 above the cylinder 7 is butt joined with a lower surface of the annular portion 21 for the cylinder head 14. The fixing bolt 18 is screwed through the bolt insertion hole 22 of the annular portion 21 into the tapped hole 20 of the connecting wall 11 and connected and fixed.

The opening portions 24 and 25 are formed on the upper part and the lower part the connecting wall 11, respectively.

A fan housing 27 of a rotating fan 26 is provided in the center of the cylinder head 14. An exhaust nozzle 28 is provided on the side of a gas container 5. A plug housing 31 of an ignition plug 30 (see FIG. 2(*a*)) is also provided is in the cylinder head 14. The ignition plug 30 within the plug housing 31 ignites and burns a mixed gas of the fuel gas and the air within the combustion chamber, as will be described later. The rotating fan 26 within the fan housing 27 agitates and mixes the fuel gas and the air, in which a gap between the tip of the rotating gap 26 and the connecting wall 11 is formed to be smaller. The rotating fan 26 is disposed between an upper opening portion 24 and a lower opening portion 25 of the connecting wall 11. Reference numeral 9 denotes a drive motor for the rotating fan 26. The exhaust nozzle 28 is connected to the gas container 5 of the cylinder head 14.

A movable sleeve 32 for making up the combustion chamber is disposed above the cylinder 7 and on the outer circumference of the connecting wall 11. The movable sleeve 32 is formed cylindrically with a larger diameter than the cylinder 7, and provided with an O-ring 34 on the internal-circumference at the lower end. The movable sleeve is disposed slidably in the vertical direction between the cylinder 7 and the cylinder head 14.

The inner circumferential surface at the upper end of the movable sleeve 32 is disposed slidably in the O-ring 23 of the cylinder head 14. The O-ring 34 at the lower end of the movable sleeve 32 is provided slidably along the outer surface of the bulge portion 16 of the cylinder 7 and its lower rib 35.

Figure 3:
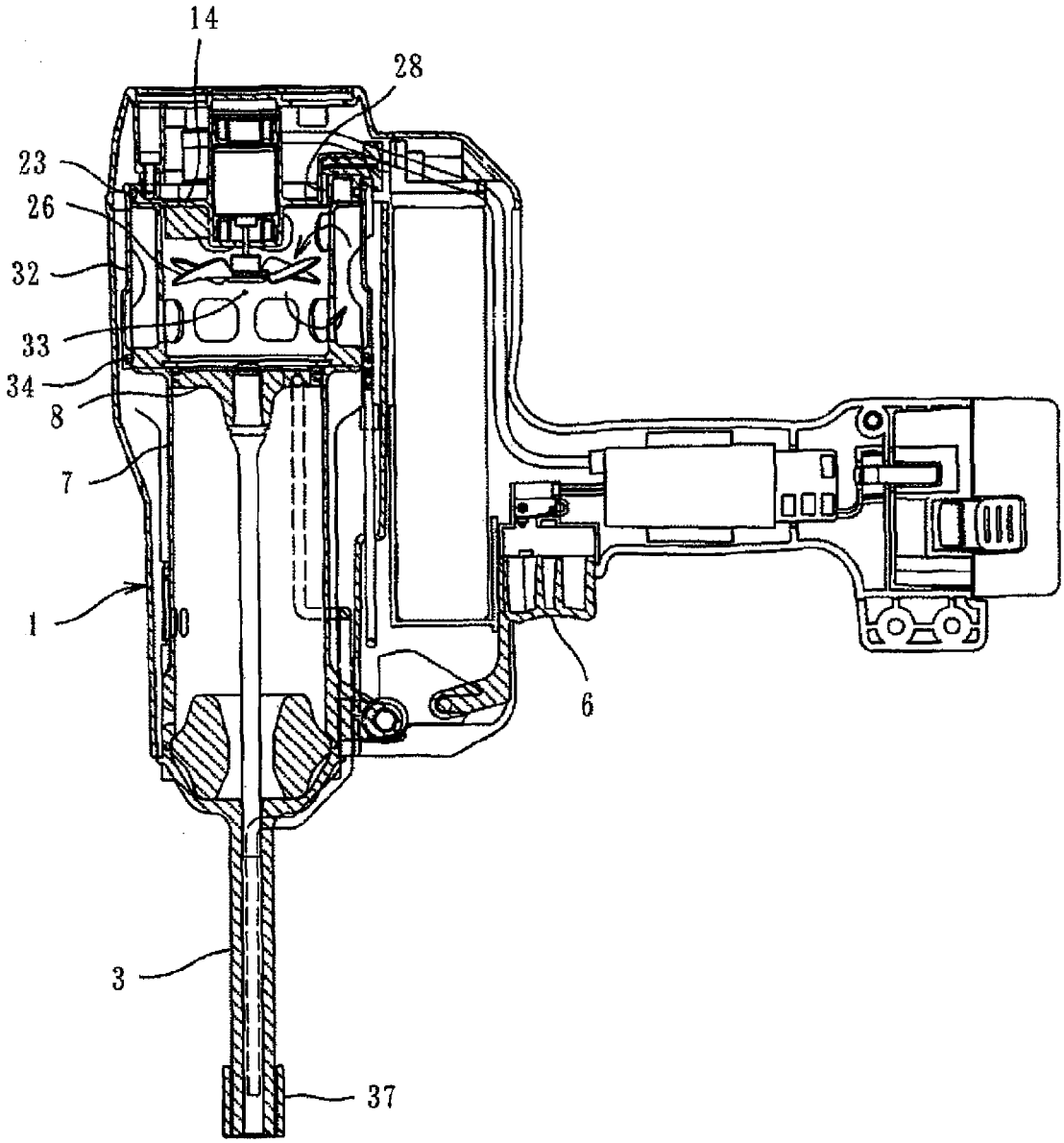
FIG. 3 is a longitudinal cross-sectional view showing the essence of the nailing machine when the combustion chamber is placed in a tightly closed state in hammering a nail.

With this constitution, when the movable sleeve 32 is moved downward as shown in FIG. 1, the seal with the upper O-ring 23 of the cylinder head 14 is released, so that the upper part of the combustion chamber 33 is opened to the outside. Similarly, the seal with the lower O-ring 34 of the movable sleeve 32 is released, so that the lower part of the combustion chamber 33 is opened to the outside of the cylinder 7. On the contrary, when the movable sleeve 32 is moved upward as shown in FIG. 3, the combustion chamber 33 formed inside the movable sleeve 32 by the upper O-ring 23 and the lower O-ring 34 is sealed and tightly closed.

A combustion chamber 33*a* in the center and a combustion chamber 33*b* outside the connecting wall 11 are constituted by the connecting wall 11.

The movable sleeve 32 is linked via a link member 36 to a contact member 37 provided slidably at the tip of the nose portion 3. The contact member 37 is urged by a spring to protrude from the tip of the nose portion 3. Accordingly, when the nose portion 3 is pushed against a driven workpiece, the contact member 37 is pushed in and moved upward, and the movable sleeve 32 is also moved upward via the link member 36, so that the tightly closed combustion chamber 33 is constituted as shown in FIG. 3. Conversely, when the nose portion 3 is detached from the driven workpiece, the contact member 37 is moved to the original position, and the movable sleeve 32 is also moved downward, so that the combustion chamber 33 is opened.

The body cover 2 made of synthetic resin has an upper cover 2*a* and a lower cover 2*b* which are abutted and fixed by the bolts, in which the upper cover 2*a* is fixed to the cylinder head 14 by a bolt 39 (see FIG. 1) and the lower cover 2*b* is fixed to a bottom of the cylinder 7 by a bolt 40 (see FIG. 2(*b*)).

Next, an operation mode of the nailing machine having the above constitution will be described below. First of all, in a driving operation of a nail, when the nose portion 3 is strongly pushed against the driven workpiece and moved upwards relative to the tool main body 1, the movable sleeve 32 is moved up together with the contact member 37 synchronously with it, so that the combustion chamber 33 is tightly closed by the upper O-ring 23 provided in the cylinder head 14 and the lower O-ring 34 provided on the outer circumference of the lower end of the movable sleeve 32, as shown in FIG. 3. A combustible gas is jetted out of the exhaust nozzle 28 into the combustion chamber 33, and after the rotating fan 26 is rotated by the motor 9 to agitate and mix the combustible gas and the air as indicated by the arrow, the gas is ignited and explosively burned with the ignition plug 30 by pulling a trigger 6. Thereby, the piston 8 is driven and the nail supplied into the nose portion 3 is delivered.

On the contrary, after the end of the driving operation, the piston 8 returns, and further the contact arm is left away from the driven workpiece to move the movable sleeve 32 downward, as shown in FIG. 1, so that the seal with the upper O-ring 23 and the lower O-ring 34 is released to open the combustion chamber 33, whereby the fresh air enters through the upper opening groove, and the combustion gas is exhausted through the lower opening groove, preparing for the next driving.

As described above, with the gas combustion type driving tool having the above constitution, the connecting wall 11 is formed to extend from the upper portion of the cylinder 7 and an upper end of the connecting wall 11 is connected to the cylinder head 14, whereby the cylinder 7 and the cylinder head 14 are integrated. Since this is the connection between the metal members, the sufficient strength is secured. Accordingly, the relative positional dimension between the cylinder 7 and the cylinder head 14 is not changed due to a combustion pressure or inertial force at the time of driving.

Figure 4:
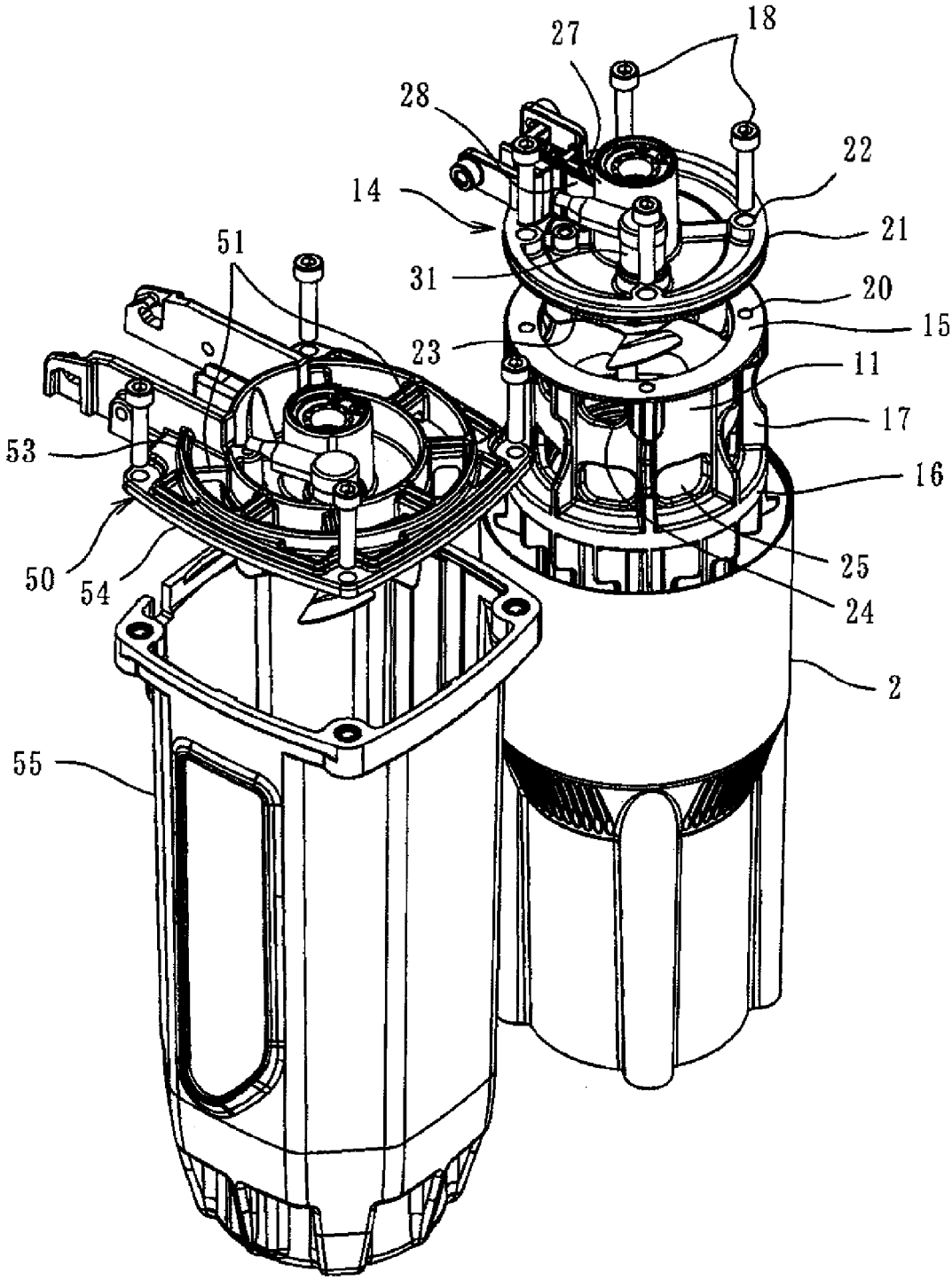
FIG. 4 is a perspective view showing the comparison between the above nailing machine and the conventional nailing machine.

Also, since the outside of the cylinder 7 and the cylinder head 14 is covered with the body cover 2 made of synthetic resin, as shown in FIGS. 1 and 4, the body cover 2 is not the member for fixing the cylinder 7 or the cylinder head 14, but simply the cover. Therefore, it is unnecessary to increase the thickness of the body cover 2 to increase the volume and the size. Accordingly, it is possible to realize the weight reduction and the slim structure.

Further, since the cylinder 7 and the cylinder head 14 are directly connected, the relative position between the cylinder 7 and the cylinder head 14 can be kept invariable, whereby there occurs no seal failure or up and down operation failure of the combustion chamber 33, and the smooth operation can be always performed.

And since the connecting wall 11 is formed cylindrically, it has so high rigidity that the cylinder 7 and the cylinder head 14 are strongly integrated, and the entire connecting wall 11 is not heavier than necessary due to the opening portion, whereby the weight reduction is not hampered. Since the connecting wall 11 is disposed inside the movable sleeve 32, when the fuel gas and the air are agitated and mixed by the rotating fan 26 at the time of driving, the fuel gas and the air blown by the rotating fan 26 flow out of the opening portion on a lower portion of the connecting wall 11, rise from there to flow through the opening portion on the upper portion into the inside, and are blown off downward by the rotating fan 26 again. Since there is no stagnation in the flow of the mixed gas, the fuel gas and the air can be mixed evenly.

The connecting wall 11 is not limited to the inside of the movable sleeve 32. It may be disposed outside. In this case, the connecting wall 11 may be formed outside a portion exceeding the operation range of the movable sleeve 32, though not shown.

Since the connecting wall 11 is formed inside the movable sleeve 32, the movable sleeve 32 itself may be formed cylindrically. No special processing is required.

With the constitution in which the connecting wall 11 is formed outside the movable sleeve 32, the connecting wall 11 can be directly seen without being hidden in the movable sleeve 32, when the body cover 2 is removed, whereby an overhaul operation can be smoothly performed.

Figure 5:
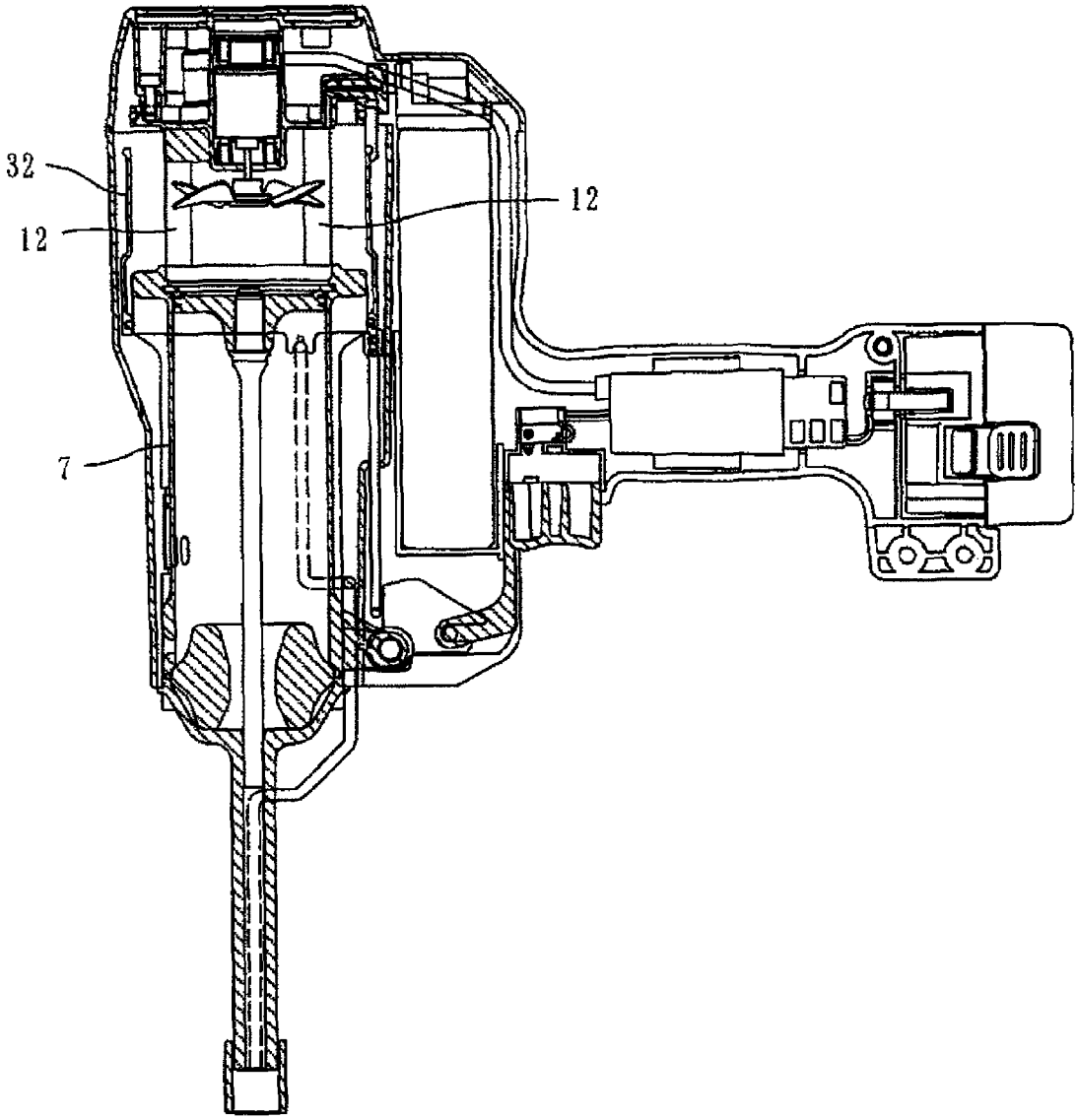
FIG. 5 is a longitudinal cross-sectional view showing the essence of the gas fuel nailing machine according to another embodiment of the invention.
Figure 6A:
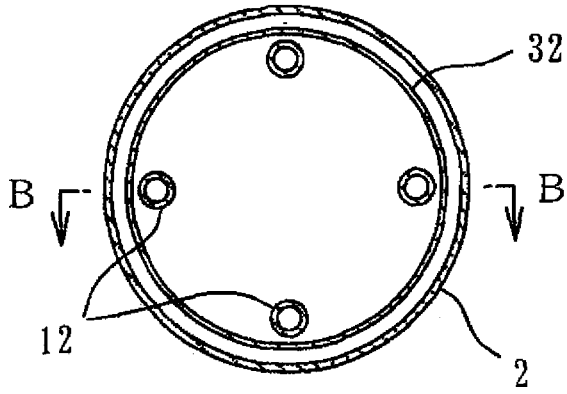
FIG. 6(*a*) is a plan view showing the essence of the cylinder head of FIG. 5, as seen from the upper surface, and FIG. 6(*b*) is a cross-sectional view of the half part, taken along the line B-B of FIG. 6(*a*).
Figure 6B:
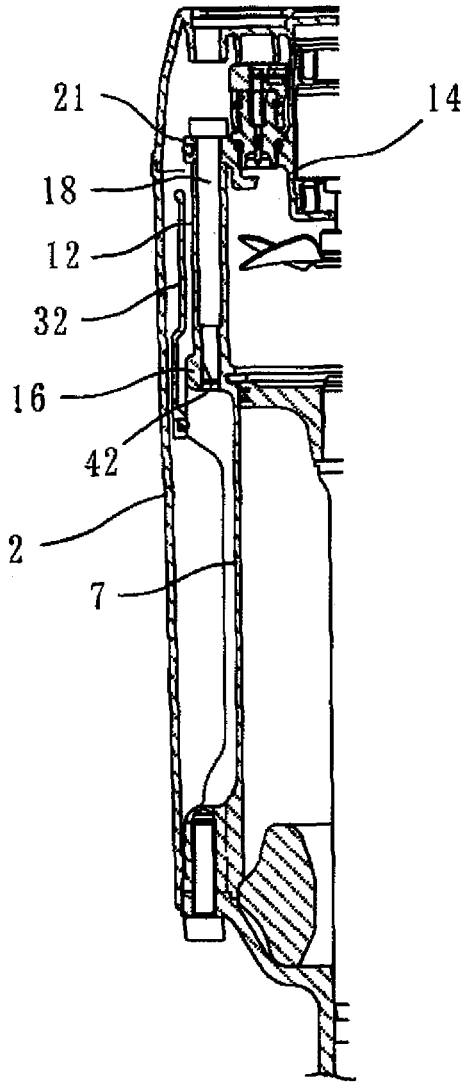

The connecting portion for connecting the cylinder 7 and the cylinder head 14 is not limited to the connecting wall formed in the wall shape. For example, it may be formed in the pillar shape. That is, the four hollow connecting pillars 12 are formed to protrude from the bulge portion 16 of the cylinder 7 and a tapped hole 42 is formed in a lower portion of the connecting pillar 12, as shown in FIGS. 5, 6(*a*) and 6(*b*). An upper end of the connecting pillar 12 is abutted against the lower surface of the annular portion 21 in the cylinder head 14 and firmly fixed by fitting a fixing bolt 18 inserted from the upper side of the cylinder head 14 into the inside of the connecting pillar 12, with its lower end screwed into the tapped hole 42.

The movable sleeve 32 is disposed to be movable up and down outside the connecting pillar 12.

With the above constitution, the integral connection between the cylinder 7 and the cylinder head 14 can be realized, as in the previous embodiment, but particularly the cylinder 7 and the cylinder head 14 can be connected by the lightest connecting portion.

Though the connecting portion is formed integrally with the cylinder in the above embodiment, the invention is not limited to this form. The connecting portion may be formed integrally with the cylinder head, or the cylinder and the cylinder head may be independently and separately formed, with the upper and lower ends fixed to the cylinder head and the cylinder.

Also, though the connecting pillar 12 is disposed inside the movable sleeve 32 in the above embodiment, the invention is not limited to this form. The connecting pillar 12 may be disposed outside the movable sleeve 32. More specifically, a concave portion not to interfere with the connecting pillar 12 may be formed in a part of the movable sleeve 32 and the connecting pillar 12 may be formed inside the concave portion in the same manner as in FIGS. 7, 8(*a*) and 8(*b*).

Since the connecting pillar 12 is formed inside the movable sleeve 32, the movable sleeve 32 itself may be formed cylindrically. No special processing is required.

With the constitution in which the connecting wall 11 is formed outside the movable sleeve 32, the connecting pillar 12 can be directly seen without being hidden in the movable sleeve 32, when the body cover 2 is removed, whereby an overhaul operation can be smoothly performed.

Figure 7:
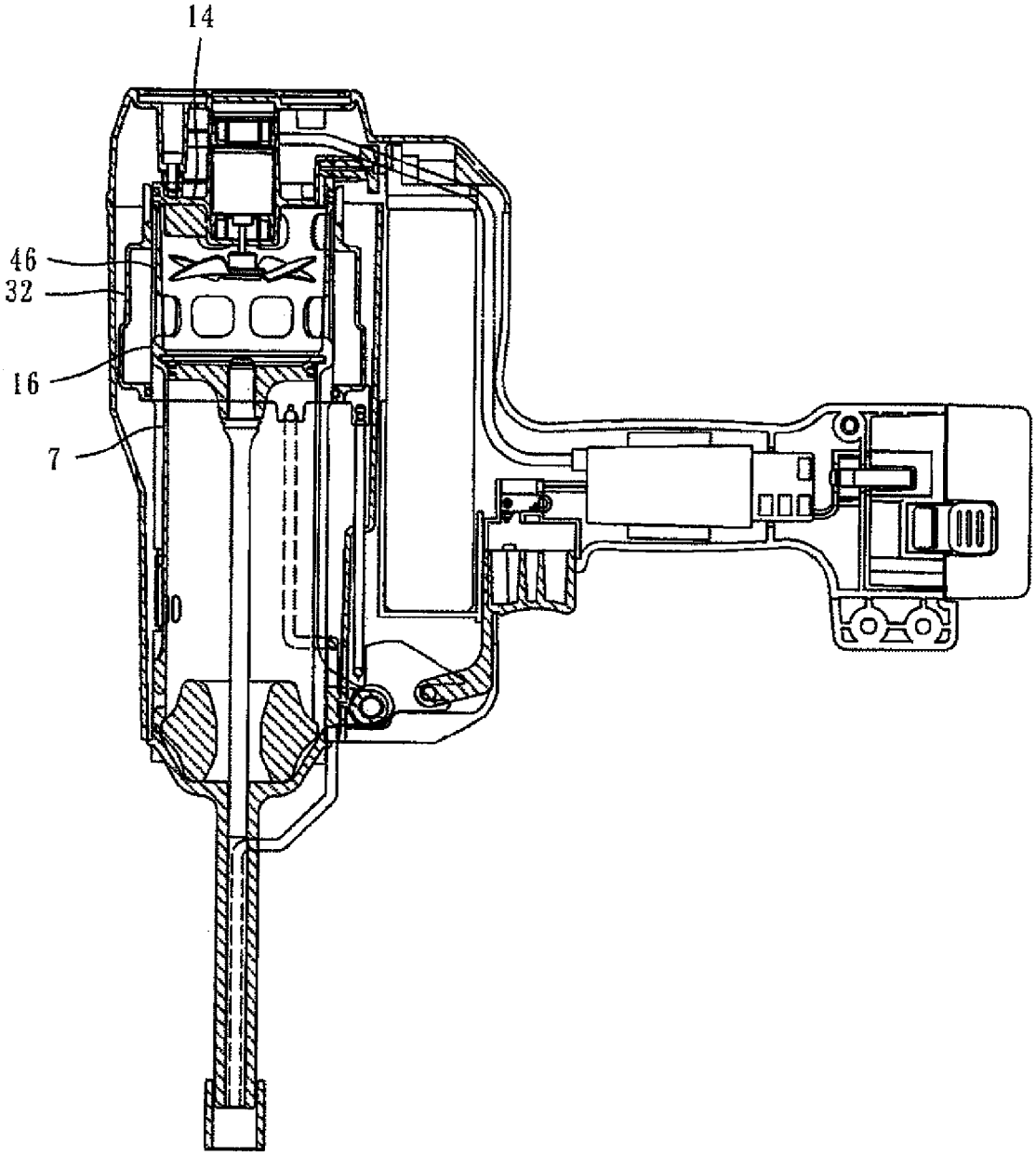
FIG. 7 is a longitudinal cross-sectional view showing the essence of the gas fuel nailing machine according to another embodiment of the invention.
Figure 8A:
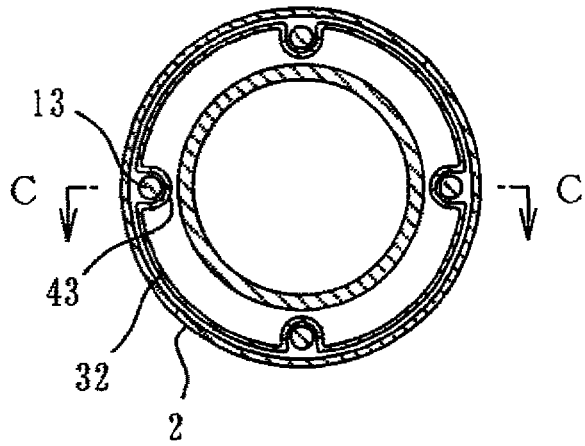
FIG. 8(*a*) is a plan view showing the essence of the cylinder head of FIG. 7, as seen from the upper surface, and FIG. 8(*b*) is a cross-sectional view of the half part, taken along the line C-C of FIG. 8(*a*).
Figure 8B:
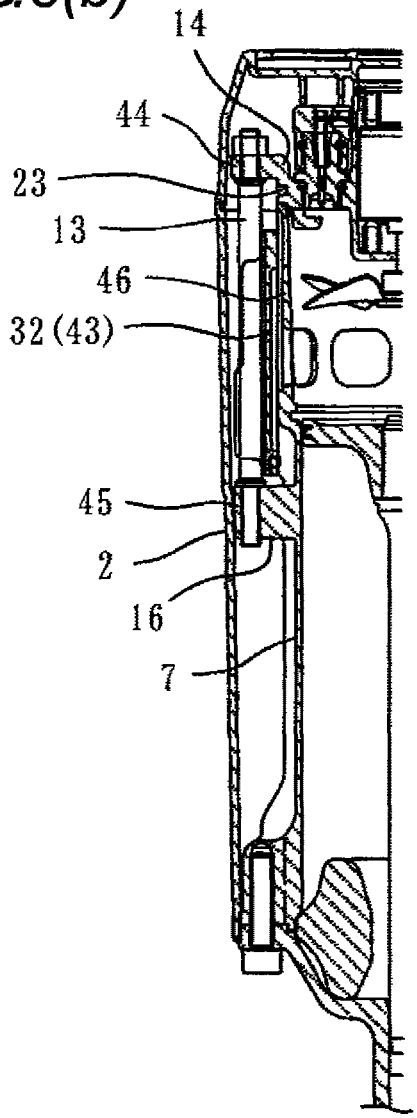

Also, the constitution for connecting the cylinder 7 and the cylinder head 14 is not limited to the above form in which the connecting portion in the wall shape or the pillar shape is interposed between the cylinder 7 and the cylinder head 14. The cylinder 7 and the cylinder head 14 may be directly fixed by a fixing bolt 13 as shown in FIGS. 7, 8(*a*) and 8(*b*). In this case, a concave portion 43 may be formed in a part of the movable sleeve 32, the longitudinal fixing bolt 13 may be disposed inside each concave portion 43, the receiving portions 44 and 45 of the fixing bolt 13 may be formed in an upper portion of the O-ring 23 of the cylinder head 14 and the bulge portion 16 of the cylinder 7, and the upper and lower receiving portions 44 and 45 may be fastened by the fixing bolt 13 to directly connect the cylinder 7 and the cylinder head 14.

An extension wall 46 including opening portions on an upper and lower portions is formed above the cylinder 7. An upper end of this extension wall 46 is abutted against the lower surface of the cylinder head 14, but not connected with the cylinder head 14.

The fixing bolt 13 may be provided inside the movable sleeve 32. In this case, the cylinder and the cylinder head may be directly connected by the longitudinal fixing bolt, not shown, instead of the connecting pillar 12, in the same manner that the cylinder 7 and the cylinder head 14 are connected via the connecting pillar 12 as shown in FIGS. 5, 6(*a*) and 6(*b*).

Though the combustion chamber is opened or closed by moving the movable sleeve upward or downward in this embodiment, the movable sleeve may be rotated, for example, to open or close the combustion chamber with the movable sleeve.

Also, means for mixing the fuel gas and the air is not limited to the fan.

Though the present invention has been described above in detail in connection with the specific embodiment, it will be apparent to those skilled in the art that various changes or modifications may be made thereto without departing from the spirit or scope of the invention.

The present application is based on Japanese patent application (2007-171660), filed on Jun. 29, 2007, the entire contents of which are hereby incorporated by reference.

Industrial Applicability

The present invention is applicable to a gas combustion type driving tool having a cylinder, a piston, and a cylinder head.

The invention claimed is:

1. A gas combustion type driving tool comprising:

a cylinder in which a piston is accommodated slidably in a vertical direction and a driver is connected in a lower side of the piston;

a cylinder head provided above the cylinder;

a cylindrical movable sleeve disposed movably in the vertical direction between the cylinder and the cylinder head;

a connecting portion for connecting the cylinder and the cylinder head, the connecting portion securing the relative position between the cylinder and the cylinder head such that a relative positional dimension in the vertical direction between the cylinder and the cylinder head is not changed due to a combustion pressure or inertial force throughout a time of driving a fastener from the driving tool, the connecting portion extending between first and second ends, the first end being fastened to the cylinder head by screwing a fixing bolt and the second end being connected to an upper end of the cylinder at a top dead center end of the cylinder such that the connecting portion extends from the upper end of the cylinder; and a body cover encasing the connecting portion.

2. The gas combustion type driving tool according to claim 1, wherein the connecting portion is formed in a wall shape, and an opening portion is formed to penetrate through the connecting portion.

3. The gas combustion type driving tool according to claim 1, wherein the connecting portion is disposed inside the movable sleeve in a radial direction of the cylinder.

4. The gas combustion type driving tool according to claim 1, wherein the connecting portion is disposed outside the movable sleeve in a radial direction of the cylinder.

5. The gas combustion type driving tool according to claim 1, wherein the connecting portion is formed of metal and the body cover is formed of synthetic resin.

6. The gas combustion type driving tool according to claim 1, further comprising a rotating fan on a fan housing provided in a center of the cylinder head.

7. The gas combustion type driving tool according to claim 1, further comprising a rotating fan on a fan housing provided in a center of the cylinder head, and wherein the connecting portion is formed of metal and the body cover is formed of synthetic resin.

8. A gas combustion type driving tool comprising:

a cylinder in which a piston is accommodated slidably in a vertical direction and a driver is connected in a lower side of the piston;

a cylinder head provided above the cylinder;

a cylindrical movable sleeve disposed movably in the vertical direction between the cylinder and the cylinder head;

a connecting portion for connecting the cylinder and the cylinder head, the connecting portion securing the relative position between the cylinder and the cylinder head such that a relative positional dimension in the vertical direction between the cylinder and the cylinder head is not changed due to a combustion pressure or inertial force throughout a time of driving a fastener from the driving tool, the connecting portion extending between first and second ends, the first end being connected to the cylinder head and the second end being connected to an upper end of the cylinder at a top dead center end of the cylinder such that the connecting portion extends from the upper end of the cylinder; and a body cover encasing the connecting portion, wherein the connecting portion comprises a plurality of connecting pillars.

* * * * *